United States Patent [19]

Parker

[11] 4,084,723

[45] Apr. 18, 1978

[54] CONTAINER WITH BUILT-IN OPENING SYSTEM

[76] Inventor: Richard P. Parker, 5550 N. 61st Ave., Glendale, Ariz. 85301

[21] Appl. No.: 801,997

[22] Filed: May 31, 1977

[51] Int. Cl.[2] ..... B65D 41/02

[52] U.S. Cl. ..... 220/277; 222/81; 220/266

[58] Field of Search ..... 220/266, 267, 277, 278; 30/358, 443; 222/80, 81, 541; 229/7 R

[56] References Cited

U.S. PATENT DOCUMENTS

| | | | |
|---|---|---|---|
| 2,554,173 | 5/1951 | Alexanian | 30/358 |
| 3,042,249 | 7/1962 | Favolise | 220/277 |
| 3,931,905 | 1/1976 | Shumway et al. | 220/278 |

*Primary Examiner*—George T. Hall

*Attorney, Agent, or Firm*—Dominik, Knechtel, Godula & Demeur

[57] ABSTRACT

A combined container and container opener is disclosed, which is formed as an integral unit with a top end wall of the container having at least one punctum positioned on its surface, and the bottom end wall of the container having at least one protruding member being positionally mounted in vertical alignment with the corresponding punctum of the top end wall. To effect opening of the container, one container having the bottom end wall protruding members is aligned on top of a second container having the top end wall with correspondingly shaped and sized puncta, and by the use of manual pressure, the protruding members will puncture the puncta to permit access to the contents of the punctured container.

17 Claims, 10 Drawing Figures

FIG. 7
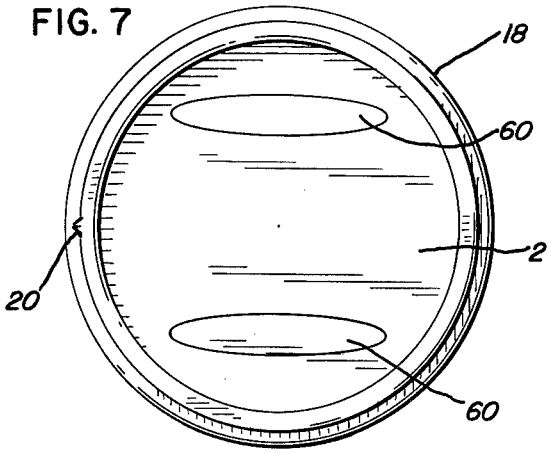
FIG. 8
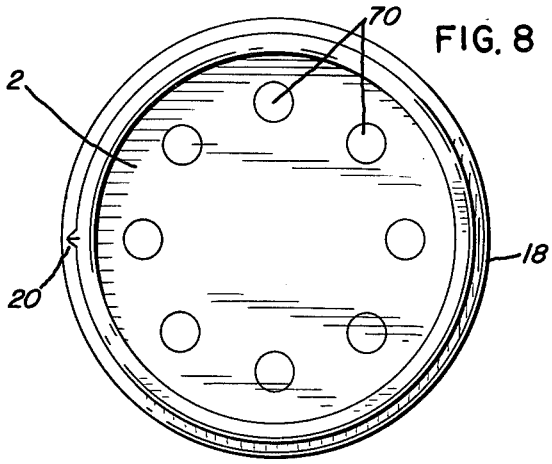
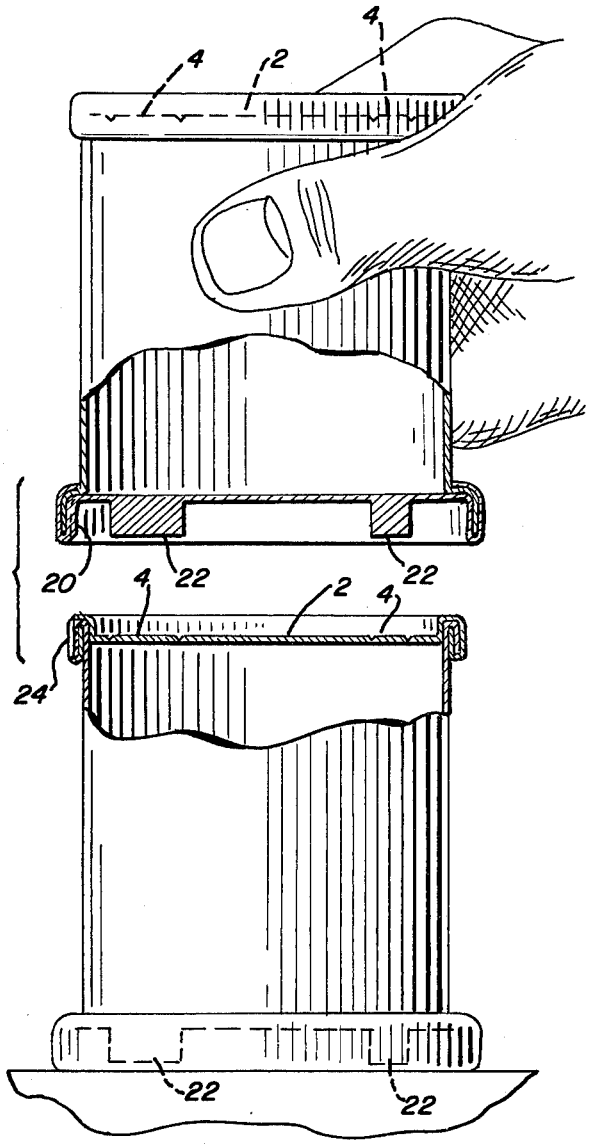
FIG. 9
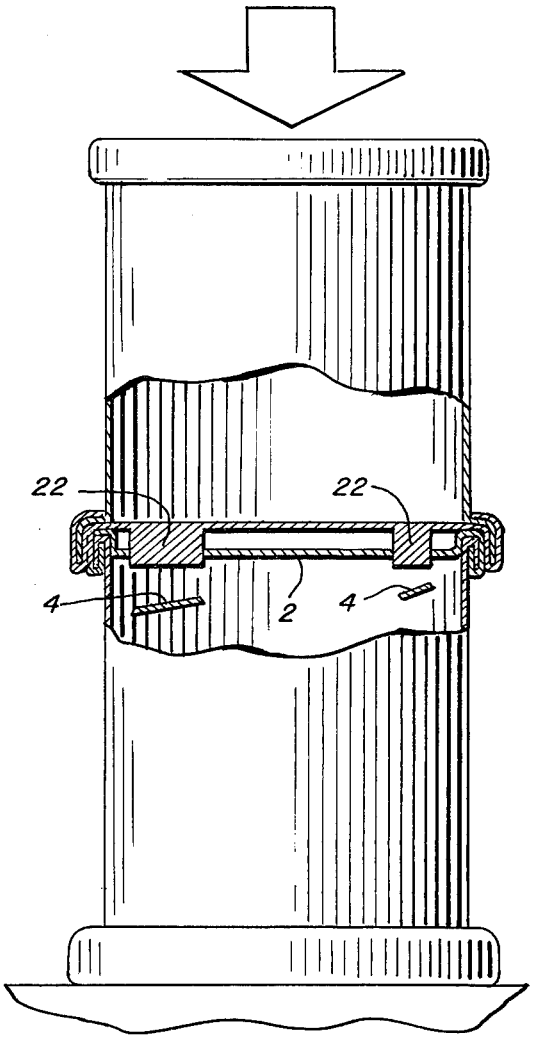
FIG. 10

CONTAINER WITH BUILT-IN OPENING SYSTEM

BACKGROUND OF THE INVENTION

A wide variety of containers are currently available on the market. Many of these containers have opening systems which are designed to eliminate the need for hand tools of any type. This is deemed to be a preferable construction for the reason that the consumer often does not have ready access to container openers or other tools with which to open a given container. This has been especially true in the area of beverage containers wherein often, the consumer purchases the goods from a retail establishment for immediate consumption, and it is therefore highly convenient to have a self-opening container available to such consumers.

To this end, a number of self opening containers have been developed, the most notable system having commercial success being the pull tab arrangement. Hence, a metallic container may be provided with a scored region at the top wall and a loop or other grasping means is attached to the scored out area. By grasping the loop, the scored area may be removed from the top wall, thereby to open the container.

Another version of a self opening container has been the provision of a metallic container wherein the top end wall is provided with a pair of puncta or weakened areas, and the containers open by merely manually pushing down on the puncta or weakened areas with any appropriate means. Usually, the consumer is obligated to use his finger or some other tool in order to push down and rupture the two puncta. Containers of this type have been especially useful in the beer industry.

Insofar as the patent art is concerned, a number of systems have been developed and patented which relate to containers having some form of opening means associated therewith. For example, U.S. Pat. No. 3,307,746 shows a container having a frangible opening device associated therewith. It will be observed that the operator need only press down on a knob member which incorporates one or more dispensing apertures which are presented to the contents of the container by pressing down on the knob member. Hence, it will be appreciated that the structure depicted in the patent does provide a form of a dispensing device incorporated within the container itself. However, it will be observed that the device as manifested in this patent has never achieved any degree of commercial success, undoubtedly for the reasons tht the cost of manufacture would be prohibitive in view of the types of beverages or other contents which could be packed within the container.

Another form of opening device for containers is shown in U.S. Pat. No. 2,784,488 wherein a perforating device is provided with a container having a plurality of puncta associated with a top wall end thereof. It will be noted that the perforating device is provided as a separate element and is positioned over the top end wall of the container and manually pressed down in order to rupture the weakened areas or puncta by means of the prongs extending downwardly from the perforating device. The difficulty with this device is that it is cumbersome indeed to be required to provide a separate perforating device for opening the container which could easily become separated from the container, and hence, defeat the utility aspect thereof.

Still another form of a self opening container is shown in U.S. Pat. No. 2,218,483 wherein the container top wall is provided with a closure member which is seated within a sealing port and basically retained in position by means of the fluid and gas pressures existing within the container. In order to open the container, the operator allegedly simply moves the closure downwardly against the seat and into the contents of the container such that the closure member actually sinks within the container. While this may appear to be a very simple device and highly convenient, nevertheless, within the framework of modern safety requirements, it is extremely objectionable to have the closure members forced into the containers itself, such that they float freely with the fluid contained therein. Should any fracturing occur, or should the closure member give off any particulate matter, it is highly likely that the consumer will actually swallow pieces of metal, plastic, or whatever other material forms the closure member and it is highly unlikely that with today's safety standards, that any such containers and opening devices would be permitted. Hence, this container has a serious drawback associated therewith.

Still another variation of an opening device for a container especially adapted to carry liquids is shown in U.S. Pat. No. 3,103,297. The structure depicted in this patent relates to a combination drinking cup and can opener, wherein the drinking cup is formed as a separate element and includes a number of can piercing instruments extending downwardly from the bottom wall thereof. In practice and as taught by the patent, the drinking cup is positioned over the top of the can and forces down such that the can piercing instruments rupture the can lid, and having thus made an opening, liquid is permitted to flow out when the operator seeks to drink from the drinking cup portion extending upwardly beyond the top portion of the can. While this may appear to be a convenient system for not only effecting the opening of a can, but providing a drinking cup, nevertheless, it will be appreciated that the manufacturer must still provide a separate element to the consumer in order to effect the opening operation. It is submitted that once the manufacturer is commited to providing a separate opening element, the same drawbacks heretofore mentioned exist, with such devices, and detracts from the ability to commercialize any such opening system.

Still another variation of the can opening system is shown in U.S. Pat. No. 3,042,249. In this instance, each can is provided with a separate can piercing blade mounted on the external side wall of the container, and is designed to be pulled away from the container side wall and operated as a can opener. It becomes quite apparent that the provision of a plurality of cans having blades extending laterally outwardly from the external side walls thereof are extremely dangerous for the consumer to use and certainly increase the possibilities of injuries to the consumer. Indeed, it is believed that under current safety standard requirements, containers having blades extending laterally outwardly from the external walls would not be permitted.

It is deemed desirable to develop a container and a container opening system which is entirely self contained with regard to the container per se, which at the same time eliminates the need or requirement for extraneous tools or instruments, and still complies with any set of safety standards in existence in the country today.

OBJECTS AND ADVANTAGES

It is therefore the principal object of this invention to provide an improved combined container and container opening system, which is entirely self contained with regard to each container, and which may be operated easily and conveniently by the operator thereof in order to effect opening of the container.

In connection with the foregoing object, it is a further object of the invention to provide a container and container opening system, in combination, wherein each container is provided with a plurality of weakened areas, referred to as puncta herein, formed in the top end wall thereof, and including a similar plurality of protruding members extending downwardly from the bottom end wall thereof, such that one container may be opened by aligning a second container on the top end wall thereof such that the bottom end wall of one container and the top end wall of the adjoining container come into contact in order to permit the protruding members of one to puncture the puncta of the adjoining container to effect opening thereof.

In conjunction with the foregoing object, it is yet another object of the invention to provide a container and container opening system of the type described wherein each of the containers further includes a peripheral skirt formed integrally with the side walls thereof and which extends downwardly beyond the confines of the bottom end wall such that the protruding members are provided in a recessed disposition relative to the overall body side wall of the container.

In connection with the foregoing objects, it is yet a further object of the present invention to provide a container and container opening system of the type described wherein each of the corresponding puncta and protruding members assume a coordinated configuration, and are aligned such that upon the stacking and nesting relationship of one can atop another, a similarly and correspondingly sized and configured protruding member will be positioned atop a corresonding punctum such that upon the application of manual pressure, the weakened area will be pushed internally into the conveyor by a hinging action and thereby effect opening of the container.

Still in connection with the foregoing objects, it is yet a further object of the invention to provide a container and container opening system of the type described wherein each container further includes guide means associated with the container for permitting the consumer to properly align and guide the positioning of one container atop the other in order to effect a proper positioning thereby to result in a proper opening of the corresponding container.

Further features of the invention pertain to the particular arrangement of the parts and elements whereby the above outlined operating features thereof are attained. The invention, both as to its organization and method of operation, together with further features thereof, will best be understood by reference to the accompanying specification taken in conjunction with the drawings.

BRIEF DESCRIPTION OF THE DRAWINGS

FIG. 7 is a top view showing still another embodiment of differently sized puncta in the top end wall;

FIG. 8 is a top view showing another embodiment wherein a series of eight puncta are positioned in the top wall;

FIG. 9 is a side elevational view, partly in cross section, showing the manner in which two containers are nested together in order to operate the protruding members of one against the puncta regions of the adjoining containers; and FIG. 10 is a side elevational view, partly in cross section, showing the containers, joined together, and the manner in which the protruding members operate to rupture and remove the puncta during the opening operation.

BRIEF SUMMARY OF THE INVENTION

In summary, the present invention provides an improved container and container opening system wherein the opening system for use in connection with each container is incorporated in the body of the container. The top end walls of each container are provided with discreet and distinct weakened areas referred to herein as puncta, while the bottom end wall of each container is provided with correspondingly sized, shaped, and arranged protruding members, which are in vertical alignment with the puncta of the top end wall such that one container may be opened by nesting a second container there atop and pressing down manually until the protruding members have ruptured the weakened areas or puncta. Another feature of the invention herein resides in the fact that the protruding members provided on the bottom end wall are entirely surrounded by a peripheral skirt such that any potential danger to the consumer is minimized if not eliminated. In addition, once the puncta has been ruptured, the broken away portions of the container's top end wall is simply pushed inwardly into the can, but are not permitted to fall freely into the contents of the container such that there is little to no danger to the consumer of being injured during the ingestion of the liquid should the consumer drink directly from the container.

DETAILED DESCRIPTION OF THE DRAWINGS

Figure 1:
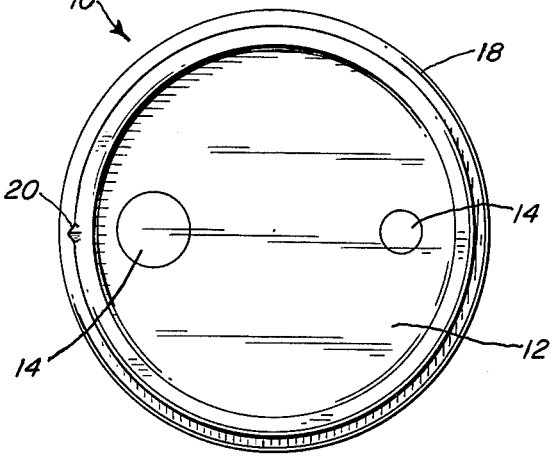
FIG. 1 is a top plan view of one embodiment of the container showing a pair of puncta in the top end wall, and a centering nib.
Figure 2:
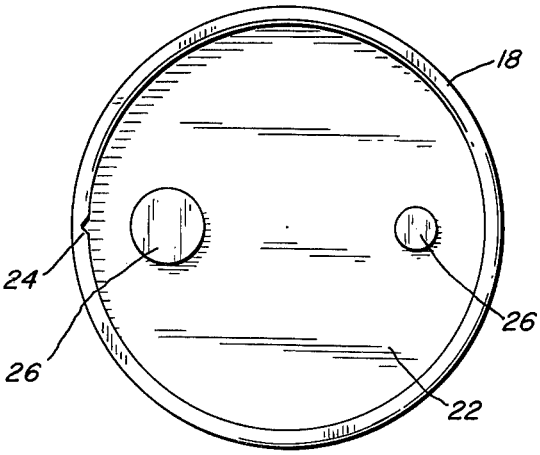
FIG. 2 is a bottom view showing the bottom of the container depicted in FIG. 1 and illustrating a pair of protruding members correspondingly sized and vertically aligned.

With reference to FIGS. 1 and 2 of the drawings, one of the embodiments of the container forming the subject invention herein as illustrated. The container, generally referred to by the numeral 10, is shown to include a top end wall 12, which is provided a pair of puncta 14. In this particular embodiment, it will be noted that the puncta are generally circular in configuration, but are generally different in diametric sizing. It will be appreciated that were the containers to be utilized for a liquid such as beer, soda pop or the like, it is difficult to have an air vent positioned in opposed relationship with respect to the general pouring spout or opening, and it is for this reason that a pair of puncta are provided, one of slightly larger diametric sizing than the other.

Figure 3:
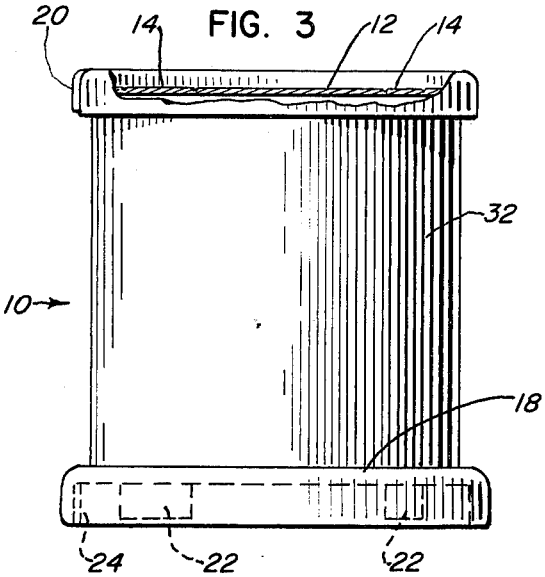
FIG. 3 is a side elevational view, partly in cross section, showing the puncta in the top end wall and the protruding members in the bottom end wall surrounded by peripheral skirts.

The top portion of the container 10 including a top end wall 12 thereof, is bounded by a peripheral rim 16 which, in FIGS. 1 and 3 of the drawings, is shown to include a centering guide in the form of a nib 20. The bottom portion of the container 10 is shown to include a bottom end wall 28 which is bounded by a bottom peripheral skirt 18. The top rim 16 and bottom skirt 18 are spaced apart by the body side wall 32 forming the main portion of the container 10. As shown in FIGS. 2 and 3 of the drawings, the bottom peripheral skirt 18 includes a notch 24 which coacts with the centering nib 20 formed as a portion of the top peripheral rim 16. The function of the centering guide nib 20 and cooperating notch 24 will be more fully discussed hereinafter.

As further illustrated in FIGS. 1 through 3 of the drawings, the bottom end wall 28 is shown to include a pair of protruding members 26 which are formed integrally with the bottom end wall 28 and extend downwardly therefrom, as shown schematically in FIG. 3. The provision of the peripheral bottom skirt 18 functions to create a recessed effect such that the protruding members 26 are located within a recessed chamber 22 formed by the bottom perhipheral skirt 18.

It will also be observed that the diametric sizing of the bottom peripheral skirt 18 is slightly larger than the outside diametric sizing of the top peripheral rim 16 such that a nesting function may be effected as shown in FIGS. 9 and 10 of the drawings. It will further be observed that the sizing and configuration of each of the protruding members 26 is identical to the puncta 14 formed in the top end wall 12 of the corresponding container 10.

As further shown in FIGS. 9 and 10 of the drawings, the centering nib 20 functions to properly center and guide the top container into nesting relationship with the bottom container by inserting the centering nib 20 within the confines of the centering notch 4. In view of the fact that the protruding members 26 may be differently sized or shaped, in order to mate with the corresponding puncta 14 which would be similarly sized and shaped, it is necessary that the two cans be aligned properly so that a downward manual pressure will result in the protruding members 26 being forced against the corresponding puncta 14 in order to effect opening of the bottom container. Clearly, if the protruding members 26 ae not properly aligned, they will not meet with the puncta 14, and hence, it will not be possible to puncture the bottom container around the area of the puncta 14 as provided.

It will therefore be appreciated that the system provided pursuant to this invention for opening a container is clearly self contained within every given container, the only requirement being that a like container be available so that a nestingly stacked arrangement can be effected in order to effectively open the container.

It will further be appreciated that in order to insure the safety of the user of the container, it is preferred to provide the puncta 14 in a form such that when manual pressure is applied to force the protruding members 26 through the correspondingly shaped puncta 14, the weakened areas will rupture inwardly relative to the top end wall 12, and will be bent down in an acute angle relative to the top end wall 12. Hence, it is advisable to provide score lines so that the greater portion of the puncta 14 will rupture, but that a bend or fold line similarly be provided so that only a substantial portion of the puncta 14 can be bent inwardly. In short, it is desirable to prevent the entire removal of the weakened area or puncta 14 since this would cause the ruptured piece to fall within the contents of the container 10 and potentially cause injury to the consumer should it fall back through the opening created after the rupturing is completed.

Hence, once the container 10 has been properly opened, the areas bounded by the weakened section forming the puncta 14 will extend inwardly into the can such that no sharp edges are presented to the consumer in the event that the container 10 is employed as a drinking vessel.

It will further be appreciated from FIGS. 4, 5, 6, 7 and 8 that different sized puncta may be employed in order to adapt the container 10 to any given usage.

Figure 4:
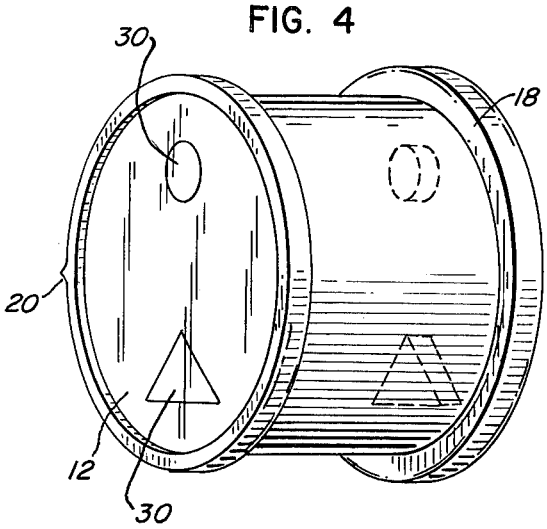
FIG. 4 is a perspective view showing another embodiment of a container wherein the puncta and protruding members, respectively, assume a circular and triangular configuration.

As shown in FIG. 4, the puncta 30 provided in container 10 are in the form of a smaller diametrically sized circle as well as a larger and triangular opening. It will be observed that the corresponding opening members 36 formed in the bottom end wall 28 of the container 10 are sized and configured similar to the puncta 30 in the top end wall 12, and in addition, are in vertical alignment therewith. Therefore, when the operator seeks to align two like cans to effect an opening thereof, the protruding members 36 will align properly with the puncta 30.

In addition, FIG. 4 illustrates still another version of a centering means to effect proper centering of one can atop the other. As was pointed out in connection with FIGS. 1 through 3 of the drawings, the centering means consisted of a centering nib 20 and a mating notch 24. In FIG. 4, the centering function may be accomplished by a pair of arrows 34 which may be accordingly printed or stenciled directly on the side wall 32 of the container 10. It is well known that in most instances where a container is employed to contain a liquid such as beer, soft drinks and the like, the can, once manufactured, will be stenciled or otherwise printed in the manner desired by the manufacturer. It is contemplated that the centering arrows 34 may be similarly stenciled or printed on the container when the predetermined indicia intended to be printed thereon to advise the consuming public as to the contents of the container. In use, the operator need only align the arrows of one container with the arrow of another container below in order to properly align the corresponding protruding members 36 with the puncta 30.

Figure 5:
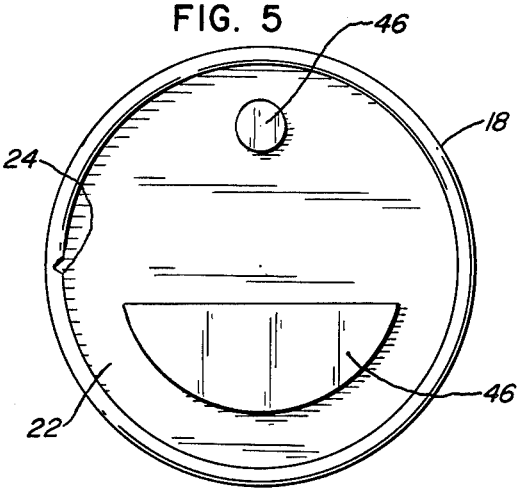
FIG. 5 is a bottom view showing another embodiment of a container wherein the protruding members are, again, sized and configured as a circular member and a semi-circular member, and including the centering groove.
Figure 6:
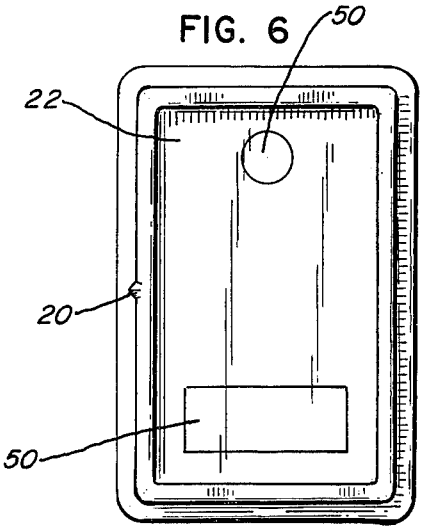
FIG. 6 is a top view of still another embodiment showing differently sized pucta in the top end wall.

In FIGS. 5, 6 and 7, still alternate embodiments of the container 10 having differently sized and shaped puncta are illustrated. In FIG. 5, the bottom view of a container showing protruding members 46 shaped in the form of a small diametric circle as well as a larger diametric semi-circle are illustrated. It will be appreciated that the corresponding puncta (not shown) located in the top end wall of the container 10 will have a shape corresponding to the protruding members 46 so that the same may be correspondingly aligned for rupturing an opening. Once again, with the embodiment illustrated in FIG. 5, there is shown the centering notch 24 located in the bottom peripheral skirt 18 which functions as an alignment means to insure proper alignment of the top can on top of the adjoining bottom can during the opening operation.

In FIG. 6 of the drawings, still another embodiment is illustrated wherein the puncta 50 are in the form of a smaller diametric circle as well as a larger rectangular area. It is contemplated that a container having puncta 50 as shown in FIG. 6 is ideally suited for use as a spice container where it is generally desirable to have a larger pouring spout to permit easy removal of the spice material located within the container 10.

In FIG. 7, still another embodiment is illustrated wherein the puncta 60 assume the configuration of an elliptical area. It is considered to be advisable to have openings of this configuration wherein the contents of the container are to include substances such as syrups, oil, soups, or other liquids which are generally of a thicker consistency and having a tendency to pour slowly.

As contradistinguished with FIG. 7, the embodiment as shown in FIG. 5 of the drawings would be preferable for foodstuffs or other materials such as peanuts or other similar fairly large shaped items which require a much larger opening to flow through. Alternatively, FIG. 8 of the drawings illustrates an embodiment which is considered to be ideal for substances such as powders, salt, pepper and the like, where a plurality of smaller openings are deemed desirable. In this embodiment, the puncta 70 assume the configuration of smaller diametric circles, wherein a plurality of such puncta 70 are located in the top end wall of the container 10. In all other respects, the containers illustrated in the various embodiments would be formed in the same manner as specifically shown in connection with FIGS. 1 through 3 of the drawings. Hence, whatever configuration which is assumed by the puncta in the top end wall of the container, similarly, the protruding members of the bottom end wall of the container would assume a like configuration. It will also be appreciated that as the shapes and configurations of the corresponding protruding members and puncta take on different shapes, it becomes more relevant to incorporate appropriate centering means in order to center the two cans properly to effect the opening thereof.

It will further be appreciated from the above description, that by providing a bottom peripheral skirt 18, in surrounding relationship relative to the protruding members 26, the protruding members 26 are effectively positioned in a recessed chamber 22 formed by the peripheral skirt 18. Hence, the possibility of any injury or damage to the operator of the opening system is substantially minimized if not eliminated, since there need be no contact between the protruding members 26, and the hands of the person manipulating the containers. It will also be appreciated that the system developed herein is applicable to any number of geometric shapes and configurations thereby to accommodate the system to any particular ultimate usage. Hence, as has been pointed out hereinabove, the system depicted and set forth herein may be employed with widely diversified mateials such as peanuts, syrups, oils, powders, fluids such as beer, soda pop, and the like. Furthermore, the system set forth herein totally eliminates the need for any extraneous implements, tools, or other opening means in order to effect opening, and hence, minimizes the potential inconvenience of losing or misplacing the opening implements. In this connection, it will be appreciated that where any materials are packaged in a container, and where the container is sold as a "six pack", such as for example, beer, soda pop, soup, and the like, the consumer will be provided with no less than six cans in the pack. Hence, it is virtually assurred that the consumer will have two like cans in order to effect the opening function for each of the cans in the "six pack".

It will be appreciated from the above description that the present invention provides a simplified and yet economical opening system associatd with a container, wherein the opening system is formed integrally with the associated container. It will also be appreciated that the opening tools or implements are formed integrally with the container and yet positioned in a recessed cavity or chamber thereby to minimize any exposure to injury or damage. Furthermore, this system lends itself to ultimate simplicity as well as a wide variety of usages depending upon the ultimate usage which, in turn, depends upon the material to be packaged.

While there has been described what is at present considered to be the preferred embodiments of the invention, it will be understood from the above description that various modifications may be made therein, and it is intended to cover in the appended claims all such obvious modifications as may fall within the true spirit and scope herein.

What is claimed is:

1. An improved container and container opener comprising in combination, an enclosed body formed by a body sidewall and being bounded by a top end wall and a bottom end wall formed therewith, said top end wall of said container having at least one punctum formed therein, said bottom end wall having puncturing means positionally mounted thereon and extending downwardly therefrom and in vertical alignment with said punctum in said top end wall, whereby said puncturing means of one container may be positioned against the punctum of another similar container such that upon the application of manual pressure forcing the containers against each other, the said punctum will be punctured by said puncturing means to permit access to the contents of the punctured container.

2. An improved container as set forth in claim 1 above, wherein said container further includes a peripheral skirt carried thereon along the pheriphery of said bottom end wall and extending downwardly beyond said bottom end wall.

3. An improved container as set forth in claim 2 above, wherein said peripheral skirt extends downwardly beyond the furthest extent of said puncturing means.

4. An improved container as set forth in claim 1 above, wherein said container is cylindrical in shape.

5. An improved container as set forth in claim 3 above, wherein said peripheral skirt is slightly dimensionally greater in diametric size than the top end wall of said container thereby to accommodate the nesting relationship of said top end wall within the confines bounded by said peripheral skirt, such that said puncturing means mounted on one of said containers may be aligned with said punctum formed in another similar container with said top end wall nested within the area bounded by said peripheral skirt and upon the application of manual pressure, said puncturing means will puncture said punctum hence permitting access to the contents of said container through said punctum.

6. An improved container as set forth in claim 5 above, wherein said puncturing means comprises at least one protruding member formed integrally with said bottom end wall and extending downwardly therefrom for a short distance.

7. The improved container as set forth in claim 6 above, wherein said protruding member is formed in the same general configuration as said punctum in said top end wall, whereby upon the nesting engagement of the bottom end wall containing said protruding member with the top end wall of another container carrying said punctum, said protruding member will easily puncture said container through said punctum thereby to open the container and permit access to the contents thereof.

8. An improved container as set forth in claim 5 above, wherein said container is provided with a pair of protruding members extending downwardly from said bottom end wall, and said top end wall is provided with two puncta, said two puncta being in vertical alignment with said two protruding members in order to effect the puncturing of the puncta of one container by the protruding members of another container.

9. An improved container as set forth in claim 8 above, wherein said containers are formed of a metallic material.

10. An improved container as set forth in claim 8 above, wherein said protruding members are formed integrally with said bottom end wall and are generally cylindrical in configuration, and further having a flat bottom end, whereby said cylindrical protruding members will effect a smooth puncturing of said puncta of said top end wall thereby presenting a smooth surface surrounding said punctured areas while still effecting an efficient opening of the container.

11. An improved container as set forth in claim 8 above, wherein said puncturing means are differentially sized in relation to each other.

12. An improved container as set forth in claim 8 above, wherein said puncturing means are differentially sized and shaped in relation to each other.

13. An improved container as set forth in claim 8 above, wherein said puncta are differentially sized in relation to each other.

14. An improved container as set forth in claim 8 above, wherein said puncta are differentially sized and shaped in relation to each other.

15. An improved container as set forth in claim 1, wherein there is a plurality of puncturing means mounted thereon with the bottom end wall, and a plurality of puncta formed therein on the top end wall.

16. An improved container as set forth in claim 1, wherein there are positioning guides located on the container to guide the nesting of the top end wall of one container with the bottom end wall of another container whereby the puncturing means of one container will be suitably mated and aligned with the appropriate puncta of the other container to effect a proper puncturing of the puncta of the one container without extensive trial and error on the part of the consumer.

17. An improved container as set forth in claim 14, wherein the positioning guides consist of a notch on the top end wall of the container and a nib on the interior wall of the skirt extending downwardly from the bottom end wall whereby said nib and notch will be engaged and appropriately mated by the consumer to effect proper positioning of the puncta and puncturing means of two containers.

* * * * *